US005257031A

United States Patent [19]

Scarpetta et al.

[11] Patent Number: 5,257,031

[45] Date of Patent: Oct. 26, 1993

[54] MULTIBEAM ANTENNA WHICH CAN PROVIDE DIFFERENT BEAM POSITIONS ACCORDING TO THE ANGULAR SECTOR OF INTEREST

[75] Inventors: Rosario Scarpetta; Pasquale Russo, both of Rome, Italy

[73] Assignee: Selenia Industrie Elettroniche Associate S.p.A., Rome, Italy

[21] Appl. No.: 959,180

[22] PCT Filed: Jul. 3, 1985

[86] PCT No.: PCT/IT85/00015

§ 371 Date: May 12, 1986

§ 102(e) Date: May 12, 1986

[87] PCT Pub. No.: WO86/00760

PCT Pub. Date: Jan. 30, 1986

Related U.S. Application Data

[63] Continuation of Ser. No. 769,590, Oct. 2, 1991, abandoned, which is a continuation of Ser. No. 660,921, Feb. 27, 1991, abandoned, which is a continuation of Ser. No. 523,254, May 14, 1990, abandoned, which is a continuation of Ser. No. 323,177, Mar. 15, 1989, abandoned, which is a continuation of Ser. No. 212,144, Jun. 27, 1988, abandoned, which is a continuation of Ser. No. 852,954, May 12, 1986, abandoned.

[30] Foreign Application Priority Data

Jul. 9, 1984 [IT] Italy ..... 48534 A/84

[51] Int. Cl.[5] ..... H01Q 3/02

[52] U.S. Cl. ..... 342/374; 343/909

[58] Field of Search ..... 342/374, 377, 356; 343/909, 911 R, 911 L

[56] References Cited

U.S. PATENT DOCUMENTS

| | | | |
|---|---|---|---|
| 3,101,472 | 8/1963 | Goubau | 343/909 |
| 3,430,249 | 2/1969 | Franks . | |
| 3,755,815 | 8/1973 | Stangel et al. | 343/911 R |
| 3,816,830 | 6/1974 | Giannini | 342/374 |
| 4,124,852 | 11/1978 | Steudel | 342/374 |
| 4,156,878 | 5/1979 | Dion | 343/909 |
| 4,178,574 | 12/1979 | Edens et al. | 343/909 X |
| 4,186,398 | 1/1980 | Minnett et al. | 342/374 |
| 4,257,050 | 3/1981 | Ploussios | 342/374 X |
| 4,321,604 | 3/1982 | Ajioka | 343/909 X |
| 4,451,831 | 5/1984 | Stangel et al. | 342/374 |
| 4,489,325 | 12/1984 | Bauck et al. | 342/374 |

FOREIGN PATENT DOCUMENTS 1553916 10/1979 United Kingdom .

OTHER PUBLICATIONS

G. Seehausen, "Feed System for Spherical Antenna Arrays with Amplitude Control", *Conference Proceedings of 12th European Microwave Conference,* Sep. 13–17, 1982, Helsinki, Finland, at pp. 661–666.

Article entitled "An Airborne Electronically Scanned X Band Narrow Beam Circular Antenna Array," by R. H. J. Cary, in *IEEE Conference on Aerospace Antennas,* Jun. 8–10, 1971, London, England, at pp. 19–24.

H. Jasik (ed.), Antenna Engineering Handbook, pp. 13–14, 14–2, and 14–3 (1st ed. 1951).

*Primary Examiner*—Mark Hellner

*Attorney, Agent, or Firm*—Bryan Cave

[57] ABSTRACT

A multibeam antenna, which has a high switching capability with high RF power levels, consisting of three subarrays (5,6,7) which suitably spaced, assure angular coverage in the azimuth hemispace from 0° to 180°. A single beam forming network (2, 3) provides each subarray with the correct field amplitude and phase distribution. Switching is performed electronically.

2 Claims, 3 Drawing Sheets

MULTIBEAM ANTENNA WHICH CAN PROVIDE DIFFERENT BEAM POSITIONS ACCORDING TO THE ANGULAR SECTOR OF INTEREST

This is a continuation of U.S. application Ser. No. 07/769,590, filed Oct. 2, 1991, (now abandoned) which is a continuation of U.S. application Ser. No. 07/660,921, filed Feb. 27, 1991 (now abandoned), which is a continuation of U.S. application Ser. No. 07/523,254, filed May 14, 1990 (now abandoned), which is a continuation of U.S. application Ser. No. 07/323,177, filed Mar. 15, 1989 (now abandoned), which is a continuation of U.S. application Ser. No. 07/212,144, filed Jun. 27, 1988 (now abandoned), which is a continuation of U.S. application Ser. No. 06/852,954, filed May 12, 1986 (now abandoned).

BACKGROUND OF THE INVENTION

This invention concerns a multibeam antenna which has a high switching capability with high RF power levels. It relates to the field of electronically switched beam antennas. The invention may find application in the field of electronic defence systems by handling single or multiple threats arriving from different directions.

The antenna can provide pseudo adaptability to the radar cross section, as it is made up of three subarrays, each of which includes eight elementary equispaced radiators which assure angular coverage of the azimuth hemispace from 0° to 180°, fed by a single beamshaping network which provides the correct field amplitude and phase distribution.

The hemispace is therefore divided into-three angular sectors, with each of which a subarray is associated. Switching between these angular sectors and within each sector is electronic.

Each subarray, as mentioned above, shapes three beams which take different angular positions on the azimuth plane through the same feed network. The selection of these beams is electronic upon designation by the system which assesses relevant direction of arrival. One of the previous solutions was to utilize arrays fed by Rothman lenses or by Butler matrixes. Another solution was provided by a series of directional antennas, one for each beam to shape, fed by an n-way switch (as many ways as the number of beams) or by transmitters.

These solutions have a number of drawbacks, among them:

- proliferation of the number of transmitters, with consequential cost and dimension increase;
- low switching speed, for the switching network, due to the high RF levels involved.

SUMMARY OF THE INVENTION

The antenna, which is the subject of this invention, consists of three subarrays (5), (6), (7) which suitably spaced, can assure angular coverage in the 0°–180° azimuth hemispace. (In a specular manner, three more subarrays, fed by a separate transmitter, can assure angle coverage in the other 180°–360° azimuth hemispace). The three subarrays are fed by a single beamforming network which provides for the correct field amplitude and phase distribution to each subarray.

The hemispace is thus divided into three angle sectors, to each one of which a subarray is associated.

Switching between these angular sectors is performed electronically and within each sector; the relevant subarray forms three beams which take different angle directions on the azimuth plane through the same feed network.

Selection of these beams is in turn electronic, upon indication from the designating system, i.e. the system which descerns the direction of arrival of the threat or threats. The beam switching and forming network consists of solid state components to obtain the high switching speeds (100–150 nsec) which are required to satisfy the tasks demanded of the system. The gain of each beam, required to established the necessary effective radiated power, is achieved by providing the array with a directivity also in the vertical plane.

This can be achieved by using as an element of the array a sectorial horn radiator, over the aperture of which a phase correcting dielectric lens is placed, which enhances radiation efficiency. A most interesting characteristic of this indicating system is that of directing the beam to the desired direction in negligible times. This is achieved through:

- high switching times with high total RF power radiated;
- high effective radiated power associated with each single beam;
- azimuth coverage over the whole round angle using two radiating systems, each having a 0° to 180° coverage sector;
- capability to adapt to the number of beams of the designating system.

This gives the antenna system the capability of handling multiple threats.

The transmitting antenna is made up of two specular subassemblies each covering a 180° sector.

It may be installed, in its preferred configuration, on board a ship (FIG. 1).

BRIEF DESCRIPTION OF THE DRAWINGS

To facilitate further discussion of the present invention, the following drawings are provided in which.

DETAILED DESCRIPTION OF THE INVENTION

Figure 1:
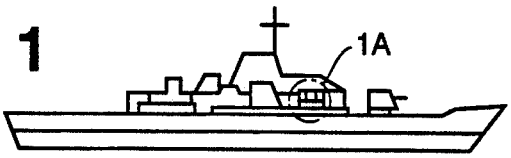
FIG. 1 shows a schematic representation of the antenna portion of the system as installed on board a ship.
Figure 1A:
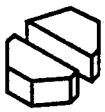
FIG. 1A shows an enlarged view of the antenna portion indicated in FIG. 1.

The figures may be described in further detail as follows. FIG. 1 shows a schematic representation of the antenna portion of the system as installed on board a ship.

Figure 2:
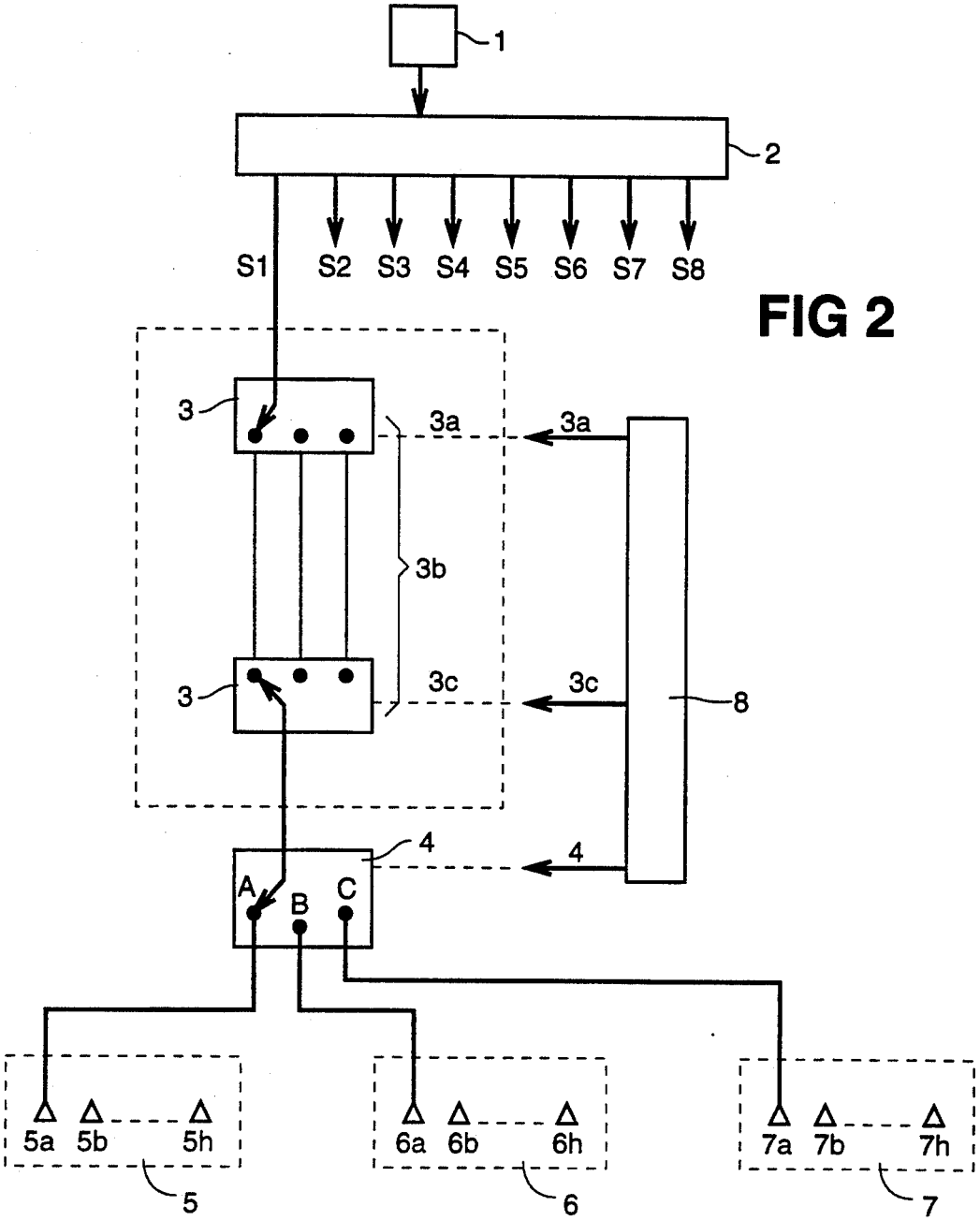
FIG. 2 shows a functional schematic diagram of the antenna system.
Figure 3:
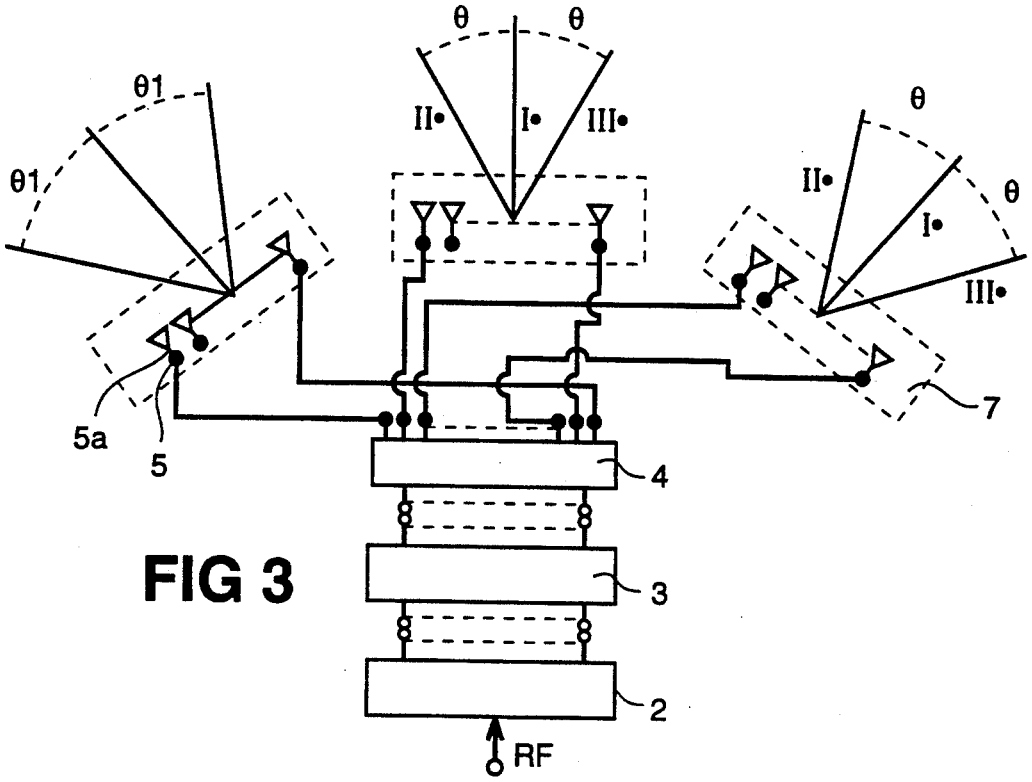
FIG. 3 shows a block diagram of the antenna system showing angular coverage of the three subarrays.

FIG. 2 shows a functional schematic of the antenna, where the elements listed below have the indicated reference numerals;

(1) is a transmitter;

(2) is a power divider;

(3) is a delay line phase shifter, where 3*a* and 3*c* are beam selectors and 3*b* are delay lines;

(4) is a subarray selector;

(5), (6), and (7) are three subarrays; and (8) is a pilot circuit;

FIG. 3 shows a block diagram of the antenna system where the elements shown are as indicated for FIG. 2.

Figure 4:
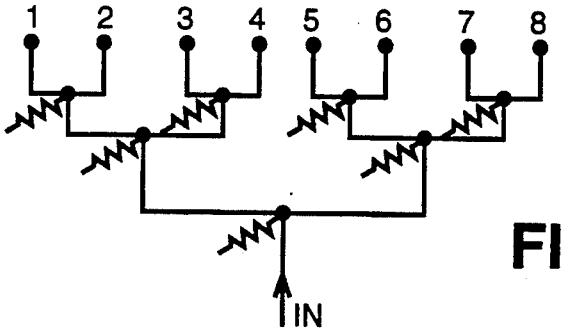
FIG. 4 shows an embodiment of the power splitter (2) of FIGS. 2 and 3.

FIG. 4 shows the power splitter (noted as (2) in FIG. 3). Here numbers 1 to 8 indicate the RF signal outputs and IN is in the input signal.

Figure 5:
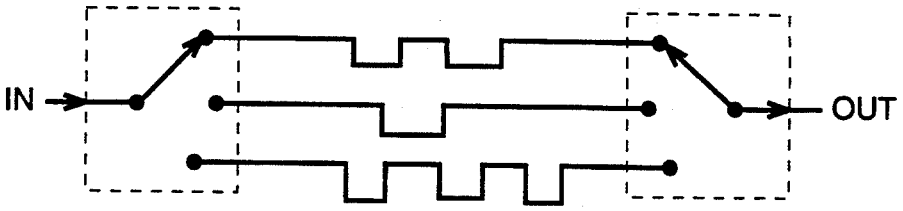
FIG. 5 shows signal activity within the delay line phase shifter 3 of FIGS. 2 and 3.

FIG. 5 shows the delay line phase shifter, indicated as a whole with numbers (2) (3) (4) in FIG. 3.

Figure 6:
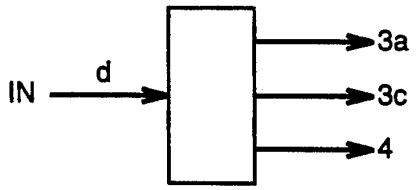
FIG. 6 shows signal activity into and out of pilot circuit 8 of FIG. 2.

FIG. 6 shows the pilot circuit, where d stands for the desired direction, 3*a*, 3*c* and 4 are the signals which enable each relevant block 3*a*, 3*c* and 4 (FIG. 2) to deliver RF power in the desired direction.

Figure 7:
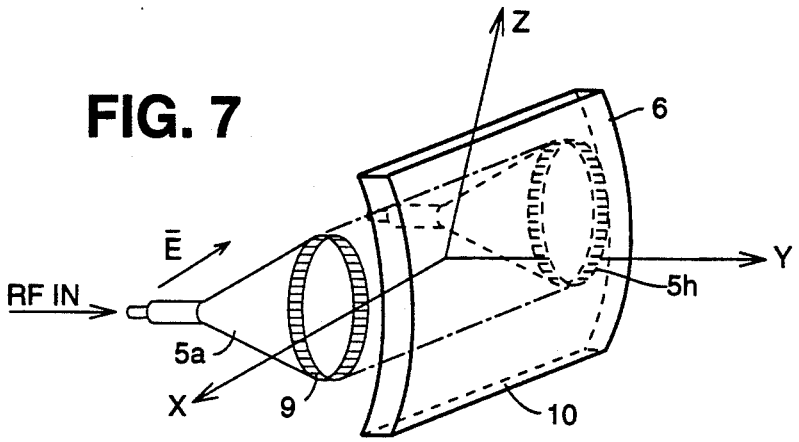
FIG. 7 shows an embodiment of one of the subarrays 5, 6 or 7 of FIGS. 2 and 3.

FIG. 7 shows a detail of one of the subarrays where X, Y, Z are the reference system and the elements listed below have the indicated reference numerals:

(5*a*) is the radiating element;

(9) is the dielectric lens for field phase correction over the varying element;

(10) is the polarization converter.

Figure 8:
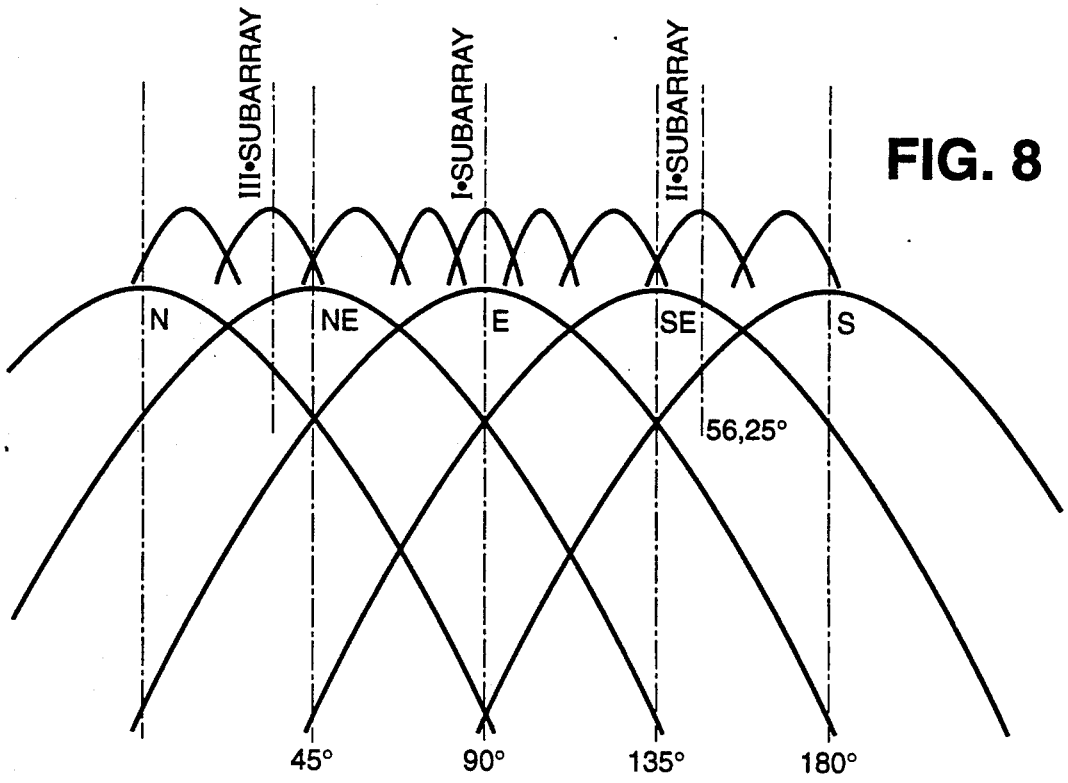
FIG. 8 shows the relationship, in graph form, between the angular coverage of the subarrays and the angular coverage of the designating system.

FIG. 8 shows a relationship between the three subarrays' angular coverage and the designating system's angular coverage.

With further reference to the figures, the antenna system's operation will be described as follows: the input RF signal (1) is split by the power divider (2) into eight parts, which are sent to the delay line phase shifter (3). The delay line phase shifter (3) provides the correct phase illumination to subarray (5) or (6) or (7) to radiate the RF signal in the desired direction. Such phase shifter consists of delay lines (36) either coaxial or triplate to assure stability in the radiation direction over the whole range of frequencies of operation.

The switching network (selector) (4) which follows the phase shifter (3) switches the predetermined distribution onto one of the three subarrays (5), (6), (7) which are geometrically set to achieve the coverage required (0°-180°). The commands to the delay line phase shifter (3) and to the switching network (subarray selector) (4) are provided in parallel to the pilot circuit (8) as a function of the desired position of the beam.

This pilot circuit can select the output signals, corresponding to the input signal, required to drive the beam selectors 3*a* and 3*c* and the subarray selector (4) and then to deliver RF power in the desired direction. The insertion loss of the phase shifting splitting and switching network is 6 dB so that the antenna gain, inclusive of losses, is 18 dB. For each subassembly, nine beam positions are achieved. The centre subarray (FIG. 3) covers the angular sector from 67.5° to 112.5°, while the two subarrays (5), (7), cover each 0°-67.5° and 112.5°-180°.

This gain distribution may be exploited to make the antenna system pseudoadaptive to ship R.C.S. for a more effective electronic defence (ECM) of the same. The advantages of this antenna system include:

the use of the array principle to switch high power RF signals rapidly over different angular directions (100-150 nsec);

the adaptation to the designating system through the use of a single transmitter associated with a single feed network which manages three subarrays to cover the angular emispace.

This adaptation also provides the antenna system with a pseudoadapting capability to the ship radar cross section, as in the angular sector where this is larger, there is a larger array gain, and therefore higher effective radiated power, known in literature as ERP.

We claim:

1. A multibeam antenna system for providing a plurality of different beam positions in the entire 0°-180° azimuth hemispace, the system comprising three separate subarrays which comprise the same number of radiating elements and are arranged to transmit signals in a respective one of three angle sectors covering the whole hemispace, one beam forming network which includes a power splitter (2) having a number of outputs corresponding to the number of radiating elements in each subarray and delay line phase shifters (3) respectively coupled to each one of the power splitter outputs, a subarray selector (4) coupled between the delay line phase shifter (3) and said subarrays (5,6,7), and a pilot circuit (8) wherein said pilot circuit (8) controls the delay line phase shifters (3) and the subarray selector (4) to delay the signal supplied from the phase shifters to the corresponding radiating element of a selected one of said subarrays (5,6,7) in such a way that said selected subarray transmits a signal of higher RF power in the desired direction, wherein each subarray comprises a phase correcting dielectric lens (9) located over the radiating elements and a polarization converter (10) in line with the lens to provide directivity in the vertical plane for providing sufficient gain for each beam to establish the necessary effective radiating power.

2. A multibeam antenna system according to claim 1, wherein the radiating element (5*a*) is a sectorial horn radiating element.

* * * * *